United States Patent [19]

Smith

[11] 4,061,075

[45] Dec. 6, 1977

[54] AUTOMATIC WEAPON

[76] Inventor: Frank P. Smith, 164-04 33rd. Ave., Flushing, N.Y. 11358

[21] Appl. No.: 730,175

[22] Filed: Oct. 7, 1976

[51] Int. Cl.[2] ..... F41C 5/02

[52] U.S. Cl. ..... 89/132; 42/11; 42/25; 89/161; 89/191 A

[58] Field of Search ..... 42/10, 11; 89/161

[56] References Cited

U.S. PATENT DOCUMENTS 726,399 4/1903 Burgess ..... 89/161

3,736,839 6/1973 Childers ..... 89/161

*Primary Examiner*—Stephen C. Bentley

[57] ABSTRACT

An automatic weapon with a receiver, a breech block fixedly mounted in the receiver, a barrel reciprocable within the receiver, a spring biasing the barrel, and a gas cylinder chamber externally of the barrel and in communication therewith, whereby upon firing of the weapon, the gases discharged from a cartridge ejected from the barrel, pass into the gas cylinder chamber means to thereby tension the spring.

8 Claims, 5 Drawing Figures

AUTOMATIC WEAPON

BRIEF SUMMARY OF THE INVENTION

The present invention relates to a weapon, and more specifically to an automatic or semi-automatic weapon for military purposes.

It is an object of the present invention to provide an automatic or semi-automatic weapon which is considerably simpler in structure than heretofore known such weapons.

More specifically, it is an object of the present invention to provide a semi-automatic or automatic weapon with a fixed, rather than a movable, breech block and a reciprocating barrel, but one that requires no locking system.

Further objects will become obvious as the detailed description proceeds.

BRIEF DESCRIPTION OF THE DRAWINGS

The invention is illustrated by way of example, in the attached drawings, in which.

DETAILED DESCRIPTION OF A PREFERRED EMBODIMENT

Figures 1, 2, 3, 4, 5:
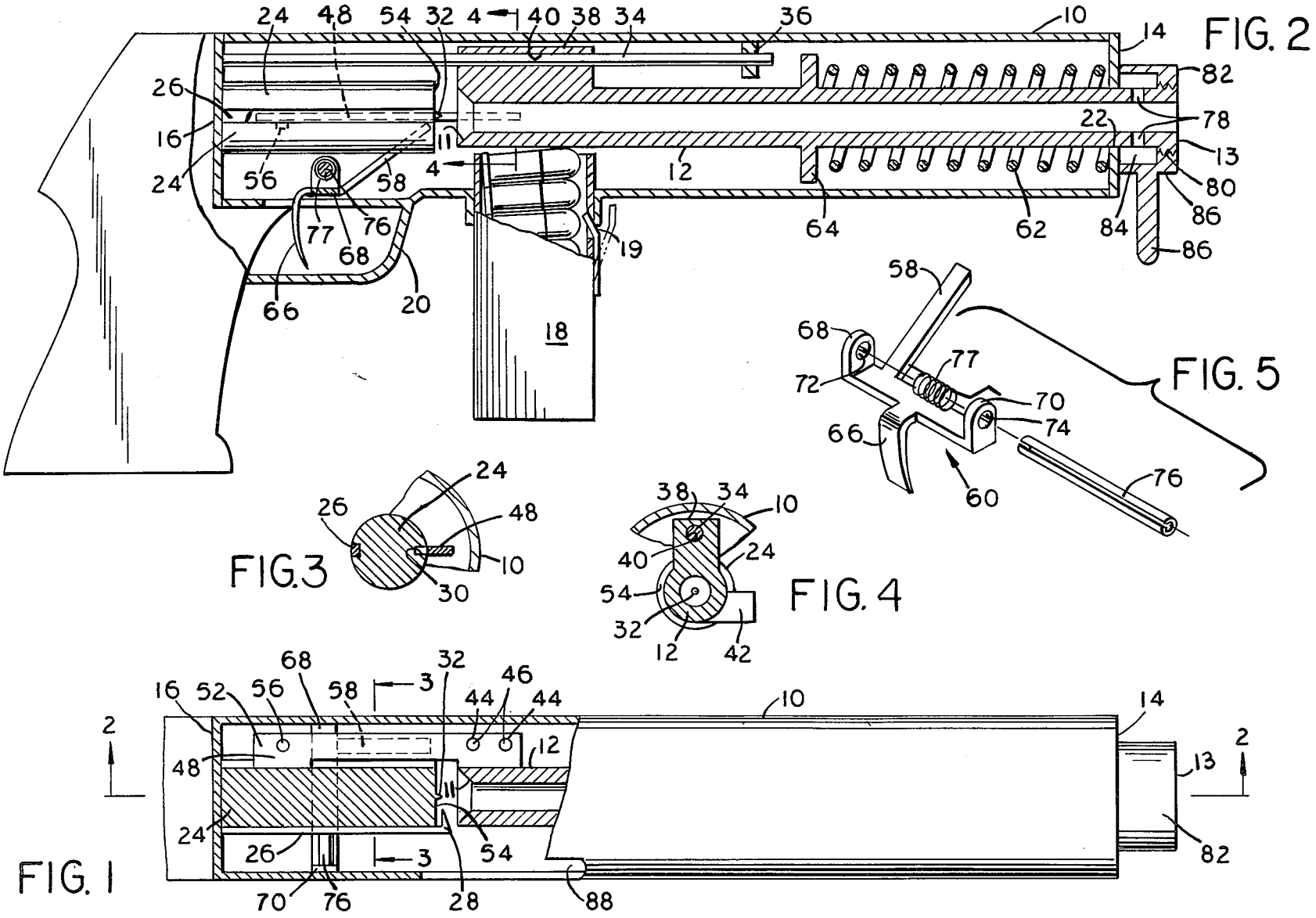
FIG. 1 is a top view of the automatic weapon according to the present invention.
FIG. 2 is a cross-section taken along the line II–II of FIG. 1.
FIGS. 3 nd 4 are cross-sections taken along the lines III—III and IV—IV respectively of FIG. 2.
FIG. 5 is a perspective view of the trigger mechanism of the automatic weapon according to the present invention.

Referring now to the drawing in detail FIGS. 1 and 2 show the automatic weapon according to the present invention in top view and longitudinal section respectively and show the main components of the weapon. A substantially cylindrical receiver 10 of heavy gage sheet metal surrounds a barrel 12. Plates 14 and 16 of relatively thick steel plate close the front and rear end of the receiver 10. The receiver is fitted with a magazine 18 only diagrammatically indicated in FIG. 2 and a trigger guard 20.

Plate 14 has a circular opening 22 through which the movable barrel 12 extends and which provides one of the supports for this barrel. A breech block or bolt 24 is fixedly connected in any suitable manner, for instance by welding, to the rear plate 16 and projects forwardly into the receiver 10 along its central longitudinal axis. An extractor 26 in the form of a spring steel member is mounted longitudinally along the right side of the breech block or bolt 24. It is, of course to be understood that this location is examplary only and the extractor could be mounted in several other locations around the breech block. The forward end of extractor 26 is hook-shaped at 28 so that it will grasp the base of a round of ammunition as it is chambered from the magazine 18. As clearly shown in FIG. 3 a relatively narrow channel 30 is cut into the left-hand side of the breech bolt 24 along its entire length, opposite the extractor 26, for a purpose which will be explained later on. Moreover, the breech bolt 24 is provided with a relatively short, fixed firing pin 32.

The movable barrel 12 reciprocates on a barrel guide 34 which is supported at both ends, namely at rear plate 16 and in holder 36, of any suitable form. The barrel guide 34 is arranged above the breech block 24.

The barrel 12 is cylindrical over most of its length, and particularly the front end thereof. However, at the rear end of barrel 12 there is an extension 38 provided with a longitudinal bore 40 thrugh which the barrel guide 34 passes. In addition, the barrel is provided with a rib or lug 42 having two holes 44. By inserting pins 46 through holes 44, an ejector guide 48 is secured to the barrel 12. The ejector guide 48 per se is made of a flat, rectangular piece of steel, roughly having the shape of the letter C with the opening of the C facing inwardly towards the center of the receiver 10. The inner edge of the ejector guide 48 is received in slot 30 cut into the left-hand side of the breech bolt 24 and prevents the barrel 12 from rotating about barrel guide 34. The length of the ejector guide 48 is such that when the barrel 12 is moved fully forwardly the rear arm 52 of the ejector guide extends past the front face 54 of the breech block 24. A relatively short, round stud 56 projects from the lower face of the ejector guide portion 52 and engages a sear arm 58 of a trigger 60 when the barrel 12 is pushed fully forwardly and prevents the barrel from moving rearwardly under the influence of a relatively strong spring 62 extending around the barrel 12 between the front plate 14 and a collar 64 of barrel 12.

In addition to the sear arm 58, the trigger 60 has a trigger arm 66. Generally, trigger 60 is stamped out of a piece of sheet steel roughly in the shape of a cross. One of the long arms of the cross forms the sear arm 58, the other the trigger arm 66. The short arms 68 and 70 are bent upwardly from the plane of the steel piece and are provided with bores 72 and 74 through which a trigger pin 76 extends. As can be seen from FIGS. 1 and 2 the sear arm 58 extends upwardly into the body of the receiver 10 and passes to the left of the breech bolt 24 to engage the stud 56 on the ejector guide 48 when the same has been moved forwardly with the barrel 12, against the force of spring 62.

The muzzle end 13 of barrel 12 extends through the hole 22 in the front receiver plate 14. A series of small holes 78 is drilled through the muzzle end 13 to form gas ports for a purpose to be exlained later. The muzzle end 13 is also provided with a thread 80 threadedly engaged by a cylindrical piece 82 which rests against front plate 14 and forms a small chamber 84, surrounding the outside of the muzzle end 13. Cylindrical piece 82 is provided with a cocking handle 86.

OPERATION

A loaded magazine is inserted in the magazine well and pressed upward until it is caught by the magazine catch (not shown) and held. Then the cocking handle 86 is pressed forwardly. This compresses spring 62. When barrel 12 is in full forward position, sear arm 58 rises up behind the stud 56 on the bottom of ejector guide 48 and lies flush against the bottom of the guide to the rear of the stud. This prevents barrel 12 from returning to its rearward position. The arm is now cocked and ready to fire.

When trigger arm 66 is pressed, it pivots on trigger pin 76. This causes the front end of sear arm 58 to move downward and out of engagement with stud 56. The compressed operating spring immediately acts against collar 64 and causes barrel 12 to move to the rear. As the lower lip 11 of the rear of the barrel passes over the magazine 18, it strikes the front of the top cartridge in the magazine and pushes it rearwardly out of the magazine. The inside of the lower lip of the firing chamber forms an inclined plane, rising toward the front, so that as the cartridge clears the lips of the magazine its nose gradually rises into alignment with the chamber. As the barrel continues its backward travel, the base of the cartridge is stopped by front face 54 of breech block 24 and the barrel is pushed back over the cartridge, thus chambering the round. At its full rearward position, the primer of the cartridge is rammed forcefully against fixed firing pin 37, thus discharging the round. At the same instant, the extractor 26 snaps into place into the cannelure about the base of the cartridge.

The recoil forces of the shot are expeded against the front face 54 of breech block 24, but since this is rigidly fastened to the receiver 10 of the weapon, the breech does not open.

the gases from the exploding powder drive the bullet down the barrel and out the muzzle end 13. As the bullet passes the gas ports 78 in the walls of the barrel near the muzzle end 13, the high pressure gases benind the bullet pass out the gas ports and expand with great force in the chamber 84 formed by the gas cylindrical piece 82, muzzle end 13 and plate 14. Since this chamber is open to the rear, the gases impinge against the front plate 14 and force the barrel to start forward. As the barrel moves forward due to the high gas pressure in the cylinder, the rear arm 52 of ejector guide 48 comes flush with the front face 54 of the bolt 24 and then passes it, thus striking the base of the cartridge. Thus the empty cartridge is fulcrumed over the extractor 26 and hurled out of the ejection port 88 in the right side of the receiver 18. At this point the barrel is in its forward position and the cycle is ready to be repeated. Firing continues until the trigger arm 66 is released or the ammunition in magazine 18 is exhausted.

I claim:

1. In a weapon: a receiver, a breech block fixed to said receiver, a barrel reciprocable within said receiver from a first position adjacent said breech block to a second position remote therefrom, spring means biasing said barrel towards said first position, trigger means associated with said receiver, a sear arm for holding said barrel in said second position, ejector guide means connected to said barrel and provided with means for engagement by said sear arm to hold said barrel in said second position, and gas cylinder chamber means externally of said barrel and in communication therewith, whereby upon firing of said weapon, the gases discharged from a cartridge ejected from said barrel, pass into said gas cylinder chamber means to thereby tension said spring means.

2. The combination according to claim 1, wherein said means on said ejector guide is a stud directly engaged by said sear arm.

3. The combination according to claim 1, wherein said breech block is provided with a slot extending substantially in the same direction as said barrel, and an extractor received in said slot and provided with means for engagement with the cannelure of a cartridge.

4. The combination according to claim 1, wherein said breech block is provided with a slot extending substantially in the same direction as said barrel, and wherein said ejector guide is slidably received in said slot.

5. The combination of claim 1, including support means provided in said receiver for longitudinally guiding and supporting said barrel.

6. The combination according to claim 5, wherein said support means is a longitudinal rod fixedly connected to said receiver.

7. The combination of claim 1, wherein said gas cylinder chamber means is partly confined by a sleeve fixedly connected to that end of said barrel which is remote from said breech block.

8. The combination of claim 1, wherein said trigger means and said sear arm form a unit.

* * * * *